US008264512B2

(12) United States Patent
Mochizuki

(10) Patent No.: US 8,264,512 B2
(45) Date of Patent: Sep. 11, 2012

(54) METHOD OF CONTROLLING ELECTRIC CONDUCTION THROUGH THERMAL HEAD

(75) Inventor: Hiroshi Mochizuki, Nirasaki (JP)

(73) Assignee: Nisca Corporation, Minamikoma-Gun, Yamanashi-Ken (JP)

( * ) Notice: Subject to any disclaimer, the term of this patent is extended or adjusted under 35 U.S.C. 154(b) by 750 days.

(21) Appl. No.: 12/289,547

(22) Filed: Oct. 30, 2008

(65) Prior Publication Data

US 2009/0115831 A1 May 7, 2009

(30) Foreign Application Priority Data

Nov. 2, 2007 (JP) ..... 2007-286786

(51) Int. Cl.
*B41J 32/00* (2006.01)
*B41J 2/38* (2006.01)
*B41J 2/375* (2006.01)

(52) U.S. Cl. ..... 347/214; 347/187; 347/223

(58) Field of Classification Search ..... None
See application file for complete search history.

(56) References Cited

U.S. PATENT DOCUMENTS

| | | | | |
|---|---|---|---|---|
| 6,206,589 | B1 * | 3/2001 | Bjork et al. | 400/120.13 |
| 6,880,991 | B2 * | 4/2005 | Tsuruta et al. | 400/120.01 |
| 2004/0125195 | A1 * | 7/2004 | Satoh | 347/234 |
| 2006/0209160 | A1 * | 9/2006 | Takano et al. | 347/171 |

FOREIGN PATENT DOCUMENTS

| | | | |
|---|---|---|---|
| GB | 2139964 | A * | 11/1984 |
| JP | H03-003092 | A | 1/1991 |
| JP | H07-214843 | A | 8/1995 |
| JP | 2002-307735 | A | 10/2002 |
| JP | 3366791 | B2 | 11/2002 |

* cited by examiner

*Primary Examiner* — Stephen Meier
*Assistant Examiner* — Alexander C Witkowski
(74) *Attorney, Agent, or Firm* — Manabu Kanesaka

(57) ABSTRACT

A thermal printer detects an environmental temperature, and directly or indirectly detects a change in tension of an ink ribbon R. A correction value is read or calculated according to at least one of the detected environmental temperature and the detected change in the tension of the ink ribbon R. Thermal energy of each heating element in the thermal head is controlled based on the correction value so as to adjustably increase or reduce number of print lines on a print medium in a sub-scanning direction.

11 Claims, 10 Drawing Sheets

METHOD OF CONTROLLING ELECTRIC CONDUCTION THROUGH THERMAL HEAD

BACKGROUND OF THE INVENTION

The present invention relates to a method of controlling electric conduction through a thermal head, in particular, a method of controlling electric conduction through a thermal head which enable optimum electric conduction in an overall printing process executed on a card-like print medium.

To produce a card-like print medium, for example, a credit card, a cache card, a license card, or an ID card, a printing apparatus as a thermal printer is conventionally used which allows a thermal head to perform thermal transfer on the card via a thermal transfer film with an ink layer to print and record desired images, texts, or the like. Such an apparatus is disclosed in, for example, Japanese Patent No. 3366791.

Furthermore, for example, Japanese Patent Application Publication No. 7-214843 discloses a thermal printer that prints the entire surface of the card-like print medium, that is, performs what is called overall printing. Additionally, for example, Japanese Patent Application Publications No. 3-3092 and No. 2002-307735 disclose a technique of controlling the amount by which a sheet as a print target medium is conveyed or controllably varying electric conduction time for the thermal head, depending on an intended condition (for example, a temperature condition) regardless of whether or not the overall printing process needs to be executed on the card or sheet as a print target medium.

However, when the overall printing process is executed on the card or sheet as a print target medium with a finite length as described above, the following phenomenon may occur. The temperature of an environment in which the printer apparatus is used or an atmospheric temperature in an apparatus body may, for example, change an outer diameter dimension of a platen roller that conveys and supports the print target medium (card or sheet) during printing or vary a winding diameter dimension of an ink ribbon and thus the tension of the ink ribbon during printing and conveyance. Thus, disadvantageously, a print size may deviate from a preset design value (expansion or contraction may occur).

In case the entire surface of the print target medium is printed, if a printing continues in a condition that the print size varies as described above to displace the thermal head from an end of the print target medium (the thermal head is prevented from abutting against the print target medium via the ink ribbon), the ink ribbon may be disadvantageously broken by heating. To prevent the above-descried problems, electric conduction through the thermal head may be controlled to turn off at a predetermined timing regardless of whether or not unprocessed print data is present. However, in this case, the overall printing of the print target medium fails to be completed, resulting in a blank in a part of the print target medium.

In view of these circumstances, an object of the present invention is to provide a method of controlling electric conduction through a thermal head as well as a thermal printer which can prevent problems such as breakage of the ink ribbon to allow the overall printing to be executed on the print target medium.

Further objects and advantages of the invention will be apparent from the following description of the invention.

SUMMARY OF THE INVENTION

To achieve the above-described object, a first aspect of the present invention is to provide a method of controlling electric conduction through a thermal head, wherein the method controls electric conduction through each heating element in the thermal head based on predetermined print information. The method comprises detecting an environmental temperature, directly or indirectly detecting a change in tension of an ink ribbon, reading or calculating a correction value according to at least one of the detected environmental temperature and the detected change in the tension of the ink ribbon, and controlling thermal energy of each heating element in the thermal head based on the correction value so as to adjustably increase or reduce number of print lines on a print medium in a sub-scanning direction.

It is configured to detect the environmental temperature, directly or indirectly detect the change in the tension of the ink ribbon, read or calculate the correction value according to at least one of the detected environmental temperature and the detected change in the tension of the ink ribbon, and control the thermal energy of each heating element in the thermal head based on the correction value so as to adjustably increase or reduce the number of print lines on the print medium in the sub-scanning direction. Thus, the overall printing is esthetically achieved on a print target medium, while preventing a possible disadvantageous situation in which a print size varies to displace the thermal head from an end of the print target medium while a printing output is continued in this condition, causing the ink ribbon to be broken by heating.

Here, in connection with the adjustable increase or reduction in the number of print lines on the card-like print medium, the end of the card-like print medium can be accurately printed to further properly prevent the above-described possible problems, by, when a trailing end of the card-like print medium being conveyed is detected, determining the number of print lines corresponding to an unprinted area on the card-like print medium, and adjustably adding the correction value to the number of print lines.

In the present aspect, the detected environmental temperature is a temperature of an external environment in which the printer body is installed, and is detected by a thermistor provided inside the printer body. Alternatively, the detected environmental temperature may be a temperature of interior of the printer body detected by the thermistor provided near a print position for the card-like print medium.

Moreover, an amount of rotation of a spool around which the ink ribbon is wound can be detected so that the change in the tension of the ink ribbon can be determined according to the detected amount of rotation of the spool. In this case, the detection of the amount of rotation of the spool is based on the amount of rotation of the spool corresponding to a conveying distance of a predetermined one of a plurality of ink panels sequentially arranged in the ink ribbon which blocks light rays from a transmission sensor.

Furthermore, according to the present aspect, an outer diameter of the ink ribbon wound around the spool is detected so that the change in the tension of the ink ribbon can be determined according to the detected outer diameter dimension of the ink ribbon. Alternatively, consumption of the ink ribbon fed out from a supply spool may be detected so that the change in the tension of the ink ribbon can be determined according to the detected consumption of the ink ribbon. Moreover, the change in the tension of the ink ribbon may be detected by directly detecting the tension of the ink ribbon before or after a conveying and printing process.

The correction value in the present aspect is calculated from the detected environmental temperature and a value corresponding to the change in the tension of the ink ribbon. The correction value as an integer value is adjusted so as to increase or reduce the number of print lines on the print medium in the sub-scanning direction. The correction value may be read from a correction table made up of the detected environment temperature and the value corresponding to the change in the tension of the ink ribbon, and the correction value as the integer value may be adjusted so as to increase or reduce the number of print lines on the print medium in the sub-scanning direction.

Furthermore, to accomplish the above-described object, a second aspect of the present invention is to provide a thermal printer printing a card-like print medium. The thermal printer comprises a thermal head with a plurality of heating elements, a platen roller provided at a print position for the card-like print medium on a conveying path, an ink ribbon in which predetermined ink is stacked and from which the ink is transferred to the card-like print medium by heat from the thermal head, a thermistor detecting an environmental temperature, ribbon tension detecting means for directly or indirectly detecting a change in tension of the ink ribbon, correction value calculating means for calculating a correction value based on at least one of temperature data detected by the thermistor and ribbon tension change data detected by the ribbon tension change detecting means, and a thermal head control section controlling thermal energy provided to the thermal head based on the correction value calculated by the correction value calculating means so as to adjustably increase or reduce number of print lines on the card-like medium in a sub-scanning direction.

The present aspect includes the thermal head with the plurality of heating elements, the platen roller provided at the print position for the card-like print medium on the conveying path, the ink ribbon in which the predetermined ink is stacked and from which the ink is transferred to the card-like print medium by the heat from the thermal head, the thermistor detecting the environmental temperature, the ribbon tension detecting means for directly or indirectly detecting the change in the tension of the ink ribbon, the correction value calculating means for calculating the correction value based on at least one of the temperature data detected by the thermistor and the ribbon tension change data detected by the ribbon tension change detecting means, and the thermal head control section controlling thermal energy provided to the thermal head based on the correction value calculated by the correction value calculating means so as to adjustably increase or reduce the number of print lines on the card-like medium in the sub-scanning direction. Thus, the overall printing is esthetically achieved on a print target medium, while preventing a possible disadvantageous situation in which a print size varies to displace the thermal head from an end of the print target medium while a printing output continues in this condition, causing the ink ribbon to be broken by heating.

Here, the present aspect further includes card end detecting means for detecting a trailing end, in a conveying direction, of the card-like print medium being conveyed, and a determination section performing predetermined determination based on a detection signal from the card end detecting means. The determination section is configured to, when the detection signal from the card end detecting means is input to the determination section, determine the number of print lines corresponding to an unprinted area on the card-like print medium and instruct the thermal head control section to add the correction value to the number of print lines to apply corresponding thermal energy to the thermal head. Thus, the end of the card-like print medium can be accurately printed to further properly prevent the above-described possible problem.

In the present aspect, the thermistor may be provided inside the printer body and may detect an external environment in which the printer body is installed. Alternatively, the thermistor may be provided near a print position for the card-like print medium and may detect a temperature of interior of the printer body.

Moreover, the ribbon tension change detecting means includes spool rotation amount detecting means for detecting an amount of rotation of a spool around which the ink ribbon is wound so that the determination section can determine the change in the tension of the ink ribbon according to the amount of rotation of the spool detected by the spool rotation amount detecting means. In this case, the ink ribbon includes a plurality of ink panels sequentially disposed in the ink ribbon. The printer further includes a transmission sensor detecting a predetermined one of the plurality of ink panels which blocks light rays. The determination section can determine the change in the tension of the ink ribbon based on the amount of rotation of the spool corresponding to a conveying distance of the predetermined ink panel for which the transmission sensor has detected a light blocking condition.

Furthermore, according to the present aspect, the correction value calculating means may further arithmetically process the correction value into an integer value. The determination section may instruct the thermal head control section to adjust the correction value as the integer value so as to increase or reduce the number of print lines on the print medium in the sub-scanning direction.

BRIEF DESCRIPTION OF THE DRAWINGS

FIGS. 10A, 10B, and 10C are diagrams illustrating detection of the amount of rotation of the supply spool for an ink ribbon, wherein FIG. 10A is a plan view of the ink ribbon, FIG. 10B is a diagram showing a sensor detection signal indicating detection of a Bk panel in the ink ribbon, and FIG. 10C is a diagram showing a clock count from an encoder detecting the amount of rotation of the supply spool for the ink ribbon.

DETAILED DESCRIPTION OF PREFERRED EMBODIMENTS

With reference to the drawings, embodiments will be described in which the present invention is applied to a thermal printer including a function of printing and recording texts or images on a card-like recording medium or a card-like print medium (hereinafter simply referred to as a card) and a function of performing a magnetic recording process on a magnetic stripe portion of the card.

<System Configuration>

Figure 7:
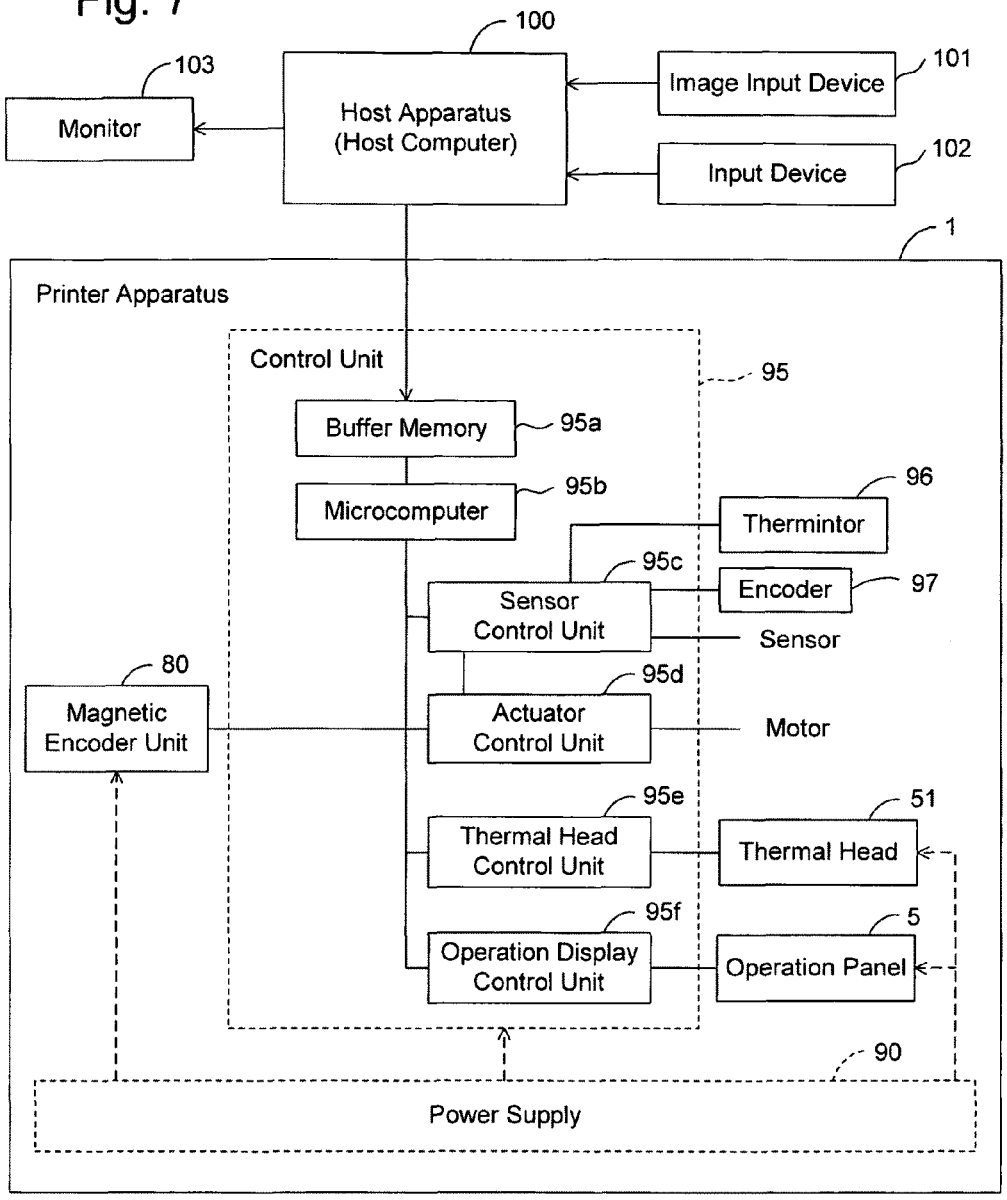
FIG. 7 is a block diagram showing a general configuration of a control section of the printer apparatus according to the embodiment.

As shown in FIG. 7, a printer apparatus 1 according to the present embodiment is connected to a higher-order apparatus 100 (for example, a host computer such as a personal computer) via an interface (not shown in the drawings) so that the upper apparatus 100 can transmit print recording data, magnetic recording data, or the like to the printer apparatus 1 to instruct the printer apparatus 1 to perform a recording operation or the like. As described below, the printer apparatus 1 includes an operation panel section (operation display section) 5 (see FIGS. 7 and 1) and is not only instructed by the higher-order apparatus 100 to perform the recording operation but also instructed via the operation panel section 5 to perform the recording operation.

The higher-order apparatus 100 is generally connected to an image input device 101 such as a scanner which reads images recorded on documents, an input device 102 such as a keyboard and a mouse which inputs instructions and data to the higher-order apparatus 100, and a monitor 103 such as a liquid crystal display which displays, for example, data generated by the higher-order apparatus 100.

<Configuration>

Figure 1:
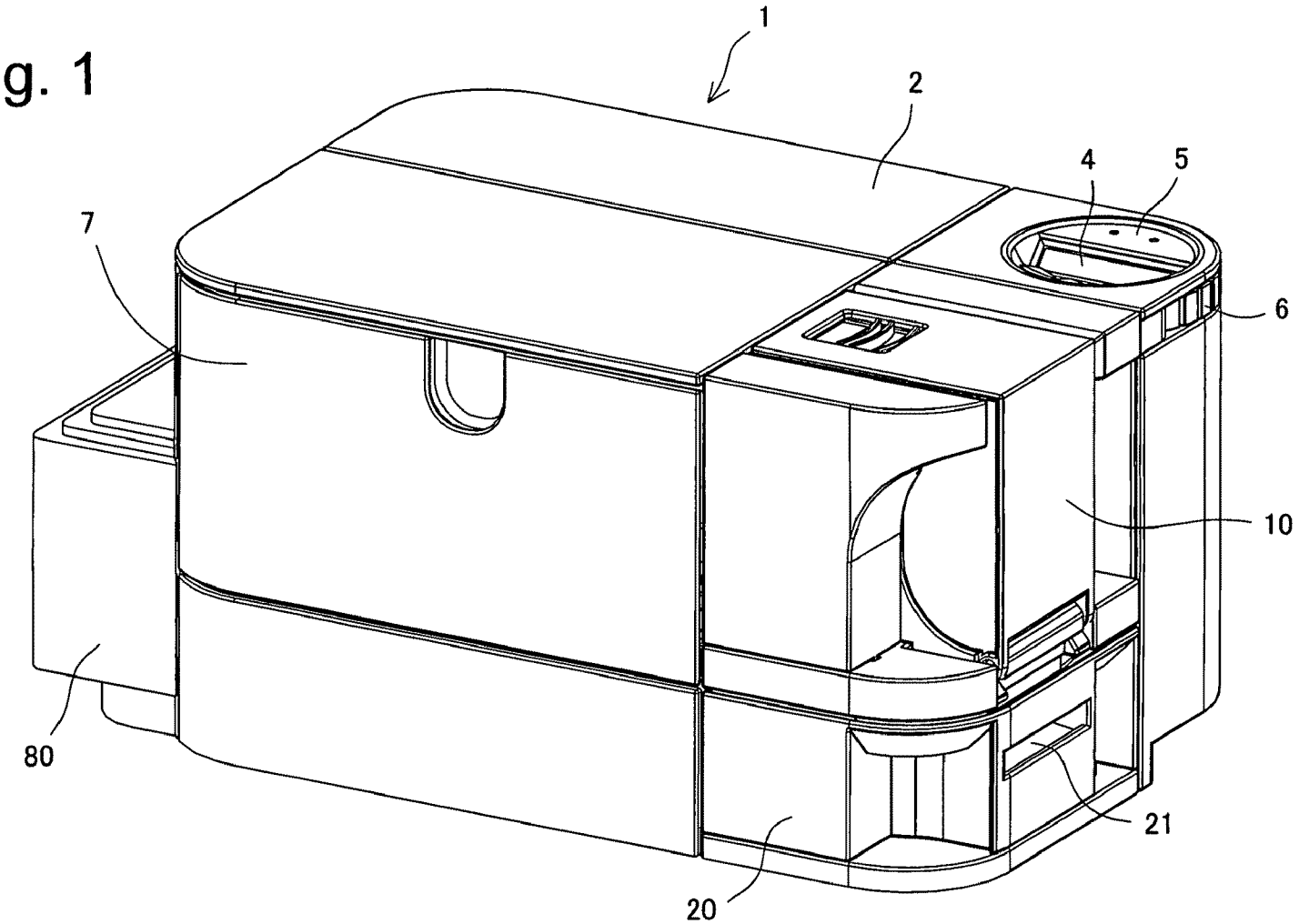
FIG. 1 is a perspective view of an appearance of a printer apparatus according to an embodiment to which the present invention is applied.

As shown in FIG. 1, the printer apparatus of the printer apparatus 1 according to the present embodiment includes a card supply section 10 which is located on one side of a casing 2 serving as an apparatus housing and in which a plurality of (about 100) blank cards not yet subjected to a recording process can be housed in a stack, the card supply section 10 being removably attached to the casing 2, a card accommodating section 20 located on the one side of the casing 2 and below the card supply section 10 and in which (about 30) cards already subjected to the recording process can be inclinedly accommodated, the card accommodating section 20 being removably attached to the casing 2, and the operation panel section 5 with a display section 4 located on the one side of the casing 2 and adjacent to the card supply section 10 to display an operational state of the printer apparatus 1 such as an error state, the operation panel section 5 allowing various settings for a printing process and a magnetic recording process to be performed. The operation panel section 5 is provided so as to be rotatable in synchronism with a rotating dial 6.

A card emission port 21 is formed in a part of the card accommodating section 20 as an opening through which after the card accommodating section 20 becomes full, an excess card already subjected to the recording process can be discharged to the exterior of the apparatus. An opening and closing cover 7 is provided on one surface of the printer apparatus so as to allow the interior of the apparatus to be accessed when a cartridge 52 containing an ink ribbon R for use in print recording described below is installed or removed.

A basic configuration of the printer apparatus 1 is disclosed in U.S. Ser. No. 12/003,260, the disclosure of which is incorporated herein.

In the present embodiment, a printing section 50 adopts a configuration of a thermal transfer printer (thermal printer) and includes a thermal head 51 provided so as to be movable forward to and backward from a platen roller 44 provided at a print position on a card conveying path P1. A plurality of heating elements 51*a* is disposed at a tip portion of the thermal head 51 (see FIG. 9. The figure schematically shows the plurality of heating elements 51*a*). The ink ribbon R is interposed between the platen roller 44 and the thermal head 51 (also see FIG. 10(*a*)); the ink ribbon R includes a plurality of color ink layers Y (Yellow), M (Magenta), C (Cyan), and Bk (Black), and the like and a protect layer O repeatedly and sequentially arranged like panels. The ink ribbon R is contained in the cartridge 52 as described above.

When information such as a letter or an image is thermally transferred to and recorded on a card C being moved along the card conveying path P1, the ink ribbon R is fed from a ribbon supply reel (ribbon supply spool) 54 and conveyed so that the entire surface of the ink ribbon R abuts against a leading end (heating elements 51*a*) of thermal head 51. The ink ribbon R is then wound around a ribbon takeup reel (ribbon takeup spool) 55 around which the ink ribbon R is wound. The ribbon supply reel 54 and the ribbon takeup reel 55 are rotationally driven by a motor (not shown in the drawings). At this time, the thermal head 51 is pressed against a surface of the card C via the ink ribbon R, while the heating elements 51*a* of the thermal head 51 are selectively operated. Then, a desired letter or image is printed on the card C. A plurality of guide shafts and a transmission sensor are disposed on a conveying path for the ink ribbon R; the transmission sensor is made up of a light emitting element 58 and a light receiving element 59 to detect the ink layer Bk (Black) in order to set a predetermined ink layer (the ink layer Y according to the present embodiment) in position.

A transmission sensor (hereinafter referred to as a first card detecting sensor) as card end detecting means is disposed on an upstream side (on the side of a conveying roller 43) of the thermal head 51 in a card conveying direction; the transmission sensor is made up of a light emitting element 48 and a light receiving element 49 to detect a leading end and a trailing end, in the conveying direction, of the card C being conveyed along the card conveying path P1 (also see FIG. 9).

A conveyance driving motor 70 is disposed in a lower part of the printing section 50 and made up of a forwardly and reversely drivable stepping motor that rotationally drives the series of conveying rollers 41, 42, and 43 and the platen roller 44 in a forward direction and a reverse direction. A rotational driving force of the conveyance driving motor 70 is transmitted, by a belt 72, to a pulley 73 via a pulley 71 provided around a rotating shaft of the conveyance driving motor 70. The driving is then transmitted to the platen roller 44 via a pulley 75 provided around a rotating shaft of the platen roller 44 by means of a belt 74 with one end thereof wound around the pulley 73. The pulley 73 is composed of a two-step pulley with the belts 72 and 74 installed on respective step portions.

A plurality of gears is engagedly disposed on the rotating shaft of the platen roller 44, on rotating shafts of the conveying rollers 41, 42, and 43, and among the rollers. The rotational driving force transmitted to the platen roller 44 is transmitted to the conveying rollers 41, 42, and 43 via the plurality of gears.

A nip roller 45 is provided on a downstream side (the ribbon takeup reel 55 side) of the platen roller 44 in the card conveying direction and along the card conveying path P1; the nip roller 45 includes a function of conveying the card C and sandwichingly holds the card C when the printing section 50 performs print recording on the card C. A feed roller 46 allowing the card C to be conveyed is provided on a further downstream side of the nip roller 45 in the card conveying direction. A transmission sensor (hereinafter referred to as a second card detecting sensor) is disposed substantially halfway between the nip roller 45 and the feed roller 46; the transmission sensor is made up of a light emitting element 56 and a light receiving element 57 to detect the leading end, in the conveying direction, of the card C being conveyed along the card conveying path P1.

A gear (not shown in the drawings) is also provided on a rotating shaft of each of the nip roller 45 and the feed roller 46. A plurality of gears (not shown in the drawings) is also provided between the platen roller 44 and the nip roller 45 and between the nip roller 45 and the feed roller 46. The plurality of gears (not shown in the drawings) meshes with one another to allow the rotational driving force of the conveyance driving motor 70 to diverge from the gear provided on the rotating shaft of the platen roller 44 to the nip roller 45 and the feed roller 46 via a driving force transmitting mechanism including the above-described pulleys, belts, and plurality of gears (not shown in the drawings).

Figure 2:
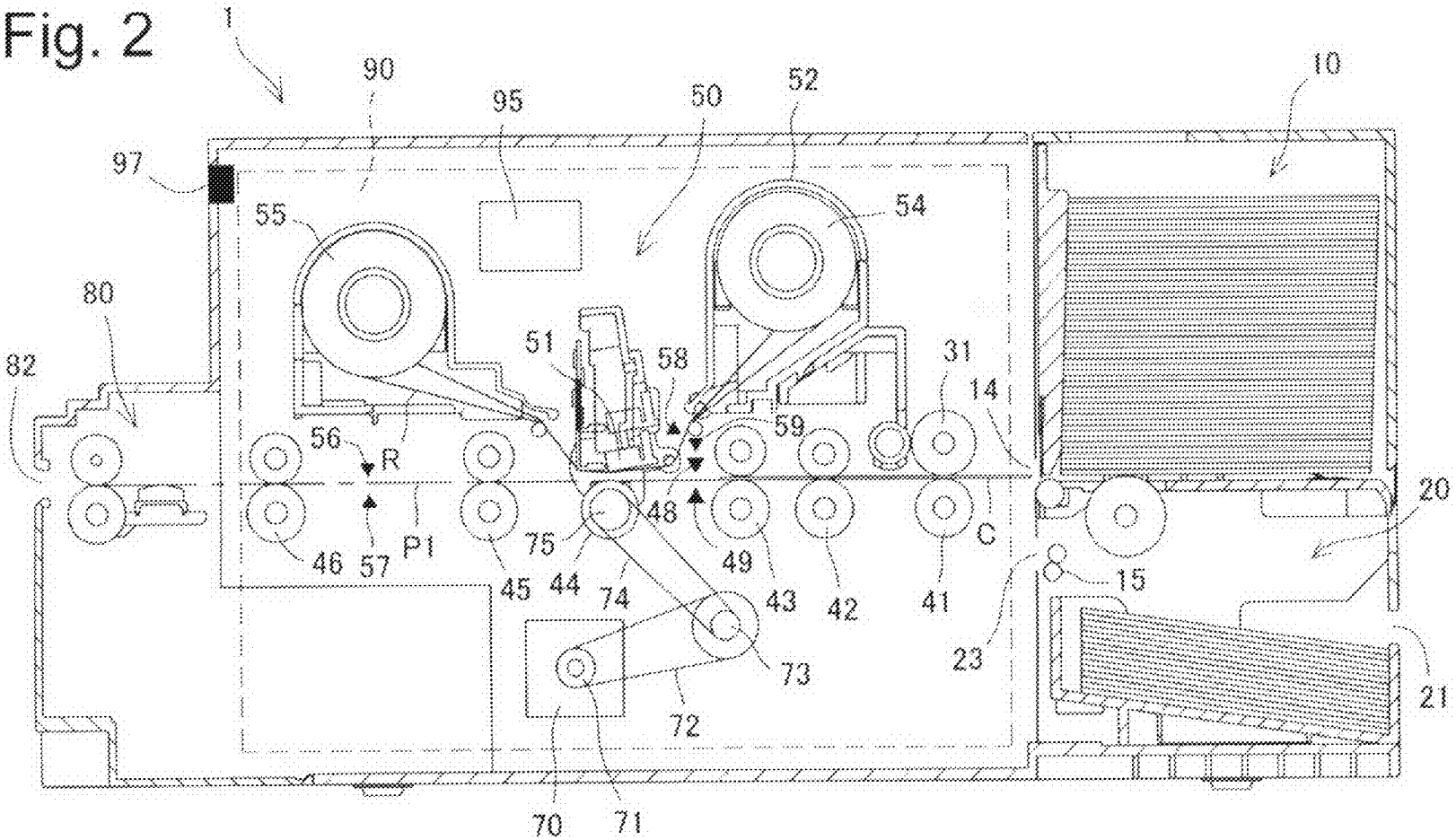
FIG. 2 is a schematic sectional view showing that a blank card not subjected to a recording process yet is carried into the printer apparatus according to the embodiment.
Figure 3:
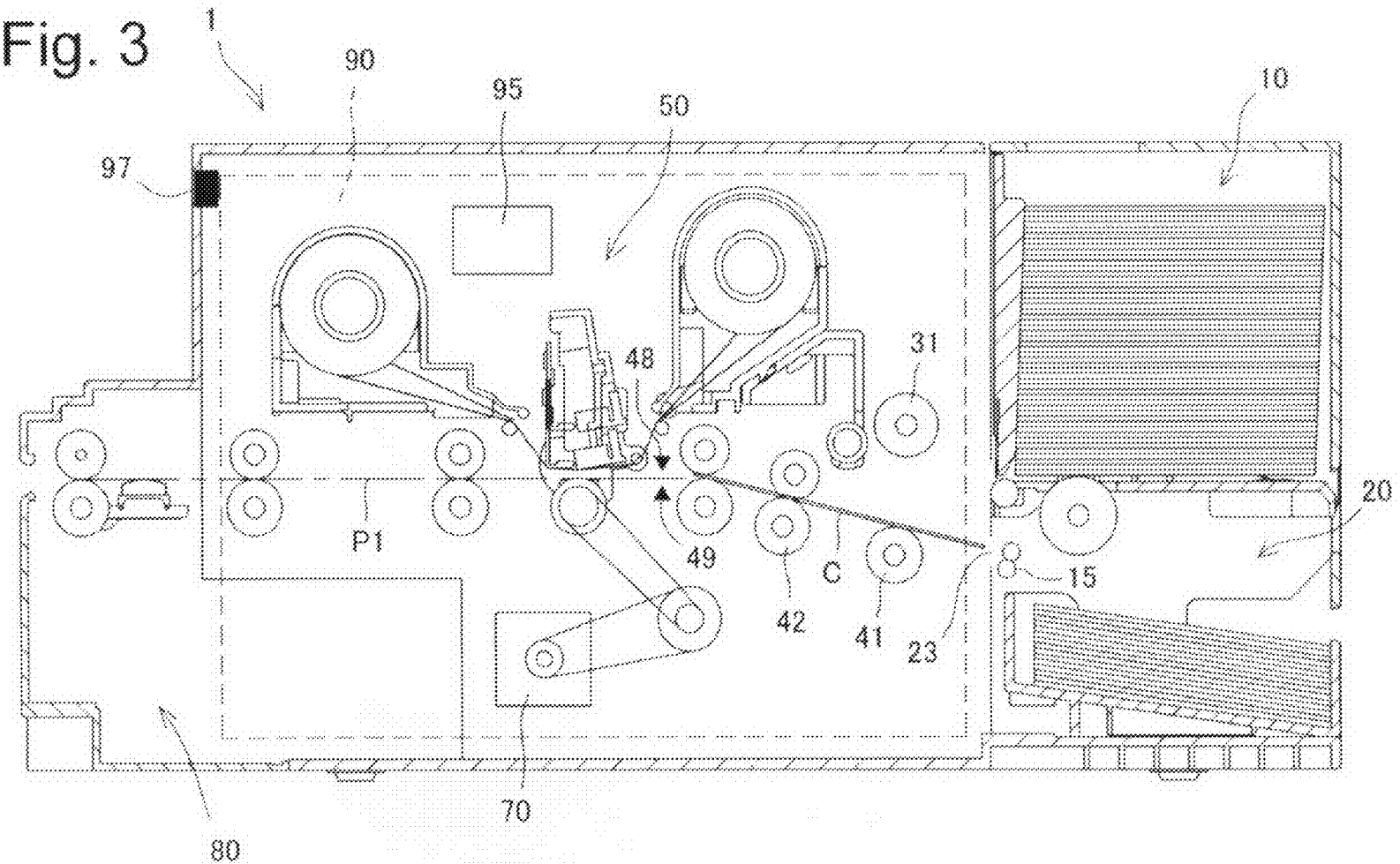
FIG. 3 is a schematic sectional view showing that the card already subjected to the recording process is discharged from the printer apparatus according to the embodiment.

Now, a control system and an electric system of the printer apparatus will be described. As shown in FIGS. 2 and 3, the printer apparatus 1 includes a control section 95 that controls the operation of the whole printer apparatus and a power supply section 90 that converts a commercial AC power supply into a DC power supply that allows the mechanical sections, the control section, and the like to be driven and operated.

<Control Section>

As shown in FIG. 7, the control section 95 includes a microcomputer 95*b* that executes a control process on the whole printer apparatus 1. The microcomputer 95*b* is composed of a CPU that operates according to a high-speed clock as a central processing unit, a ROM that stores basic control operations (programs and program data) of the printer apparatus 1, a RAM that works as a work area for the CPU, and an internal bus that connects the CPU, the ROM, and the RAM together.

An external bus is connected to the microcomputer 95*b*. A buffer memory 95*a* is connected to the external bus to temporarily store an interface (not shown in the drawings) that allows communication with the higher-order apparatus 100, print recording data (hereinafter also referred to as print information) to be printed on the card C, and magnetic recording data (hereinafter also referred to as magnetic information) to be magnetically recorded in the magnetic stripe portion of the card C.

The external bus is connected to a sensor control section 95*c* that controls signals from various sensors, an actuator control section 95*d* that controls motor drivers and the like which feeds driving pulses and driving power to motors, a thermal head control section 95*e* that controls the thermal energy of the thermal head 51 (heating elements 51*a*), an operation display control section 95*f* that controls the operation panel section 5, and a magnetic encoder unit 80. The sensor control section 95*c* is connected to the first card detecting sensor made up of the light emitting element 48 and the light receiving element 49, the second card detecting sensor made up of the light emitting element 56 and the light receiving element 57, the transmission sensor made up of the light emitting sensor 58 and the light receiving sensor 59, a thermistor 96 that detects an environmental temperature, an encoder 97 (denoted by reference numeral 121 in FIG. 8) serving as spool rotation amount detecting means for detecting the amount of rotation of the ribbon supply reel (ribbon supply spool) 54, and other sensors (not shown in the drawings). The actuator control section 95*d* is connected to a stepping motor 61, a conveyance driving motor 70, and other motors (not shown in the drawings), and an actuator 34 and the like. The thermal head control section 95*e* is connected to the thermal head 51. The operation display control section 95*f* is connected to the operation panel section 5.

In the present embodiment, the thermistor 96, which detects the environmental temperature, is provided inside the printer body on the other side (ribbon takeup reel 55 side) of the printer 1 (casing 2). The thermistor 96 is configured to detect the temperature (outside air temperature) of the exterior of the printer body to which air is fed from an adjacent air supply fan (not shown in the drawings). That is, the thermistor 96 is provided so as to detect the environmental temperature of the place in which the printer apparatus is installed. However, the thermistor 96 may be provided near the thermal head 51 (heating elements 51*a*) of the platen roller 44, that is, near the print position for the card C to detect the environmental temperature inside the printer body. Moreover, the thermistor 96 may be provided on both of the above-described positions to use the detected temperature data depending on an application.

The power supply section 90 supplies an operating/driving power supply to the control section 95, the thermal head 51, the operation panel section 5, and the magnetic encoder unit 80 (see FIG. 7).

Figure 8:
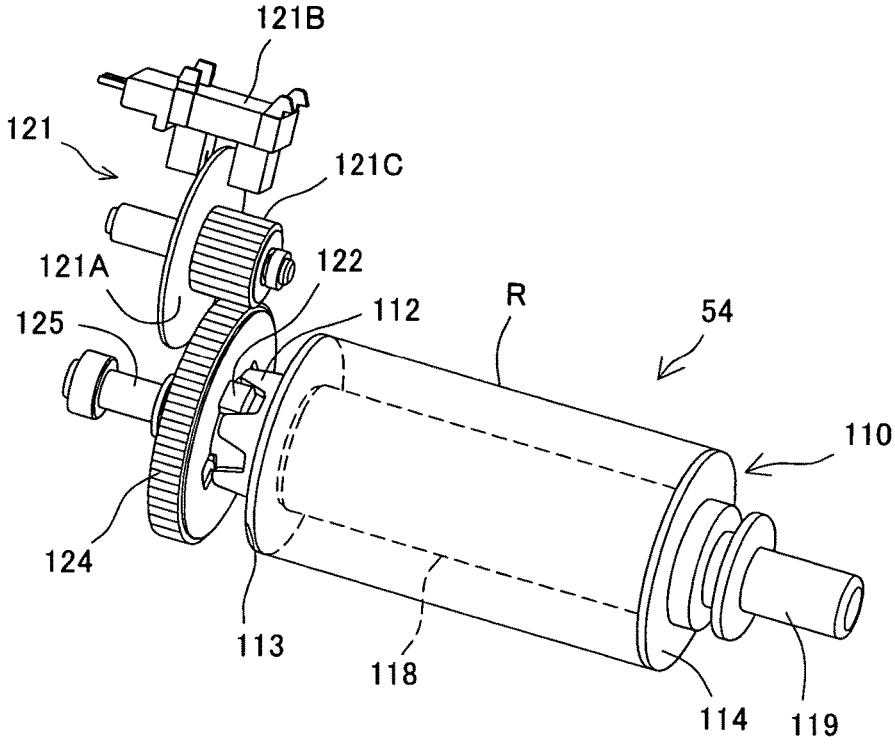
FIG. 8 is a perspective view of an appearance of an engaging section of the printer apparatus which engages with a spool main body on a supply spool side.

Now, an engaging section of the printer apparatus 1 which engages with a spool main body 110 on the ribbon supply reel (ribbon supply spool) 54 side will be described with reference to FIG. 8. FIG. 8 shows how an engaging section 112 of the ribbon supply reel 54 engages with an engaging member (engaging projecting portion 122) on the apparatus main body side. In the ribbon supply reel 54 and ribbon takeup reel 55 shown in FIGS. 2 and 3, the ink ribbon R is wound (held) around the spool main body 100. The unused ink ribbon R is wound around the ribbon supply reel 54. The used ink ribbon R (already subjected to thermal transfer by the thermal head 51) is wound around the ribbon takeup reel 55.

The spool main body 110 includes a cylindrical ribbon holding section 118 with flanges 113 and 114 provided on opposite sides thereof, the holding section 118 holding the ink ribbon R, the engaging section 112 provided at one side end of the ribbon holding section 118 and adjacent to the flange 113, and a shaft portion 119 provided on an opposite side of the engaging section 112 and adjacent to the flange 114 and having a smaller diameter than the ribbon holding section 118.

The flanges 113 and 114 regulate the position where the ink ribbon R is wound around the ribbon holding section 118, in an axial direction of the spool main body 110. Thus, even when the spool main body 100 rotates, the unused ink ribbon R is fed from the ribbon holding section 118 without being displaced (in the case of the ribbon supply reel 54). The used ink ribbon R is properly wound around the winding ribbon holding section (in the case of the ribbon takeup reel 55). The shaft portion 119 is rotatably supported in a circular cutout (not shown in the drawings) formed in the cartridge 52.

The engaging section 112 has six trapezoidal projecting portions projecting toward an end. In other words, grooves are formed in the engaging section 112; each of the grooves is formed of inclined surfaces formed on side surfaces of each of the projecting portions and a bottom portion that connects the inclined surfaces of the adjacent projecting portions together.

As shown in FIG. 8, the engaging section on the apparatus main body corresponding to the engaging section 112 of the ribbon supply reel 54 is composed of a plurality of members. That is, a support shaft 125 is fixed to an apparatus frame (casing 2) and rotatably supports, by means of a shaft, an engaging member shaped like a disc and including a gear at an outer edge thereof. Two engaging projecting portions 122 project form a side of the engaging member which engages with the engaging section 112; the engaging projecting portions 122 differ from the projecting portions of the engaging section 112 and are located opposite each other (so as to form a phase difference of 180° in a rotating direction of the engaging member). A spring 124 is wound around the support shaft 125 to slidably bias the engaging member (engaging projecting portions 122) toward the engaging section side.

When the cartridge 52 is installed in a cartridge installing section, tips of the projecting portions of the engaging section 112 of the spool main body 110 may abut against (hit) tips of the engaging projecting portions 122, provided on the engaging member on the apparatus main body side to prevent smooth insertion. Since the engaging member is slidable in the axial direction of the support shaft 125, when the tips of the projecting portions of the engaging section 112 hit the tips of the engaging projecting portions 122, the engaging projecting portions 122 retract toward the apparatus frame side (the opposite side of the spool main body 110). Subsequent rotation of the engaging member or the spool main body 110 places the engaging projecting portions 122 into the grooves among the projecting portions of the engaging section 112. The engaging projecting portions 122 are biased toward the spool main body 110 side by the spring 124. Each of the engaging projecting portions 122 and the projecting portions (the grooves among the projecting portions) of the engaging section 112 which are located adjacent to this engaging projecting portion 122 contacts one another at two points.

As shown in FIG. 8, a gear 121C meshes with a gear on the engaging member. A rotating plate 121A with a slit (not shown in the drawings) formed therein coaxially with the gear 121C is secured to the gear 121C. An integral transmission sensor 121B made up of a light emitting element and a light receiving element is located at a position such that the light emitting and receiving elements sandwich the rotating plate 121A therebetween. Thus, the rotating plate 121A and the sensor 121B form the encoder 121 as spool rotation amount detecting means for detecting the rotation amount of the ribbon supply reel (ribbon supply spool) 54 from which the ink ribbon R is fed.

In the present embodiment, the encoder 121 as described above is configured as ribbon tension change detecting means for indirectly detecting a change in the tension of the ink ribbon R. That is, as the print recording process is executed on the card C, the ink ribbon R is conveyed from the ribbon supply reel (ribbon supply spool) 54 side to the ribbon takeup reel (ribbon takeup spool) 55. In keeping with the conveyance, the ribbon diameter of the ribbon supply reel (ribbon supply spool) 54 decreases, whereas the ribbon diameter of the ribbon takeup reel (ribbon takeup spool) 55 increases.

In this case, in the present embodiment, a driving source (not shown in the drawings) is used to drivingly wind the ink ribbon R on the ribbon takeup reel (ribbon takeup spool) 55 side. The tension of the ink ribbon R being conveyed decreases with increasing ribbon diameter of the ribbon takeup reel (ribbon takeup spool) 55. That is, the tension of the ink ribbon R increases as the ink ribbon R is closer to a winding start position. The tension of the ink ribbon R decreases as the ink ribbon R approaches a winding end position. In the present embodiment, the spool shaft (support shaft 125) serving as a rotating center of the ribbon supply reel (ribbon supply spool) 54 includes a torque limiter (not shown in the drawings) to generate a back tension on the ribbon supply reel (ribbon supply spool) side. In this case, the back tension of the ink ribbon R being conveyed increases with decreasing ribbon diameter of the ribbon supply reel (ribbon supply spool) 54. Similarly, the back tension of the ink ribbon R decreases as the ink ribbon R is closer to an initial feed-out stage, and increases as the ink ribbon R is consumed.

As described above, if the ribbon takeup reel (ribbon takeup spool) 55 is defined as a reference, as the ribbon winding diameter increases, the tension of the ink ribbon R, which affects the card C being conveyed, decreases owing to the relationship with the back tension on the ribbon supply reel (ribbon supply spool) side.

It has been found that even though the rotation torque of a driving motor (not shown in the drawings) driving a winding driving shaft for the ink ribbon R is set to a given value, the tension of the ink ribbon R decreases relatively with increasing winding diameter of the ribbon takeup reel (ribbon takeup spool) 55.

As a result, the print size of a text or an image printed on the card C by the thermal head 51 tends to increase in the sub-scanning direction (feed direction) of the card C as the ink ribbon R is closer to the winding start position. The print size of the text or image printed on the card C by the thermal head 51 tends to decrease in the sub-scanning direction (feed direction) of the card C with increasing the winding diameter of the ribbon takeup reel (ribbon takeup spool) 55 (as the printing process progresses).

Thus, if the card C is subjected to the overall printing, the print size may vary as described above. Then, a printing output may be continued with the thermal head 51 displaced from an end of the card C (the trailing end in the conveying direction), that is, with the thermal head 51 failing to abut against the card C via the ink ribbon R. As a result, the ink ribbon R may be broken by heating. Certain measures are required to solve this problem.

A similar phenomenon (problem) has been found to result possibly from the environmental temperature. That is, an increase in environmental temperature tends to increase the outer diameter of the platen roller 44. A decrease in environmental temperature tends to reduce the outer diameter of the platen roller 44. If a stepping motor is adopted as a driving source for the platen roller 44, an increase in the outer diameter dimension of the platen roller 44 increases the amount by which the card C is fed per predetermined rotation angle. As a result, an increase in environmental temperature tends to increase the print size of the text or image printed on the card C by the thermal head 51, in the sub-scanning direction (feed direction). In contrast, a decrease in environmental temperature tends to reduce the outer diameter dimension of the platen roller and thus the print size of the text or image printed on the card C by the thermal head 51, in the sub-scanning direction (feed direction).

Control of electric conduction through the thermal head 51 (heating elements 51*a*) intended to solve this problem will be described below with reference to FIGS. 9 and 10. FIG. 9 shows a timing during printing of the card C when the trailing end of the card C in the conveying direction thereof is detected by the transmission sensor made up of the light emitting element 48 and the light emitting element 49 and serving as a card end detecting member. The card is 86 mm in length, and a design distance denoted by reference character L in the figure (the distance corresponds to an unprinted portion) is 25 mm. Thus, a design distance on the card which corresponds to a printed portion is 61 mm; the distance is obtained by subtracting the distance of 25 mm denoted by L from the card length of 86 m, and is located on a downstream side of the light emitting element 51*a* of the thermal head 51 in the card conveying direction.

If the entire surface of the card C is printed and when resolution is set to 300 DPI, the design values are as follows. The number of print lines provided by the thermal head 51 (heating elements 51*a*) and corresponding to a card length of 86 mm is 1,016. When the trailing end of the card C is detected, the number of printed lines is 721 in association with the distance of 61 mm. The number of unprinted lines is 295 in association with the distance of 25 mm. As described above, since the print size may be increased or reduced by a change in the tension of the ink ribbon R and/or the environmental temperature, the design number of unprinted lines may actually not be 295 but 298 (more than 295) or 292 (less than 295).

Figure 9:
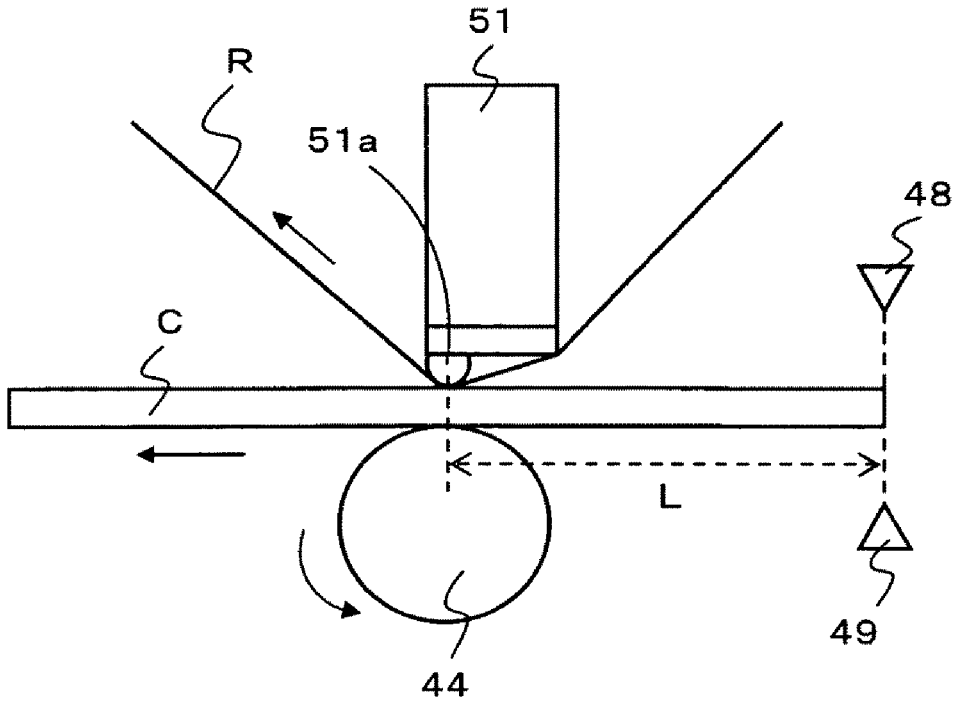
FIG. 9 is a schematic view of a printing operation being performed on the card, illustrating a timing at which an electric conduction through a thermal head is controlled.

The actual number of unprinted lines is determined by the microcomputer 95*a*, serving as a determination section, when detection signals from the transmission sensor made up of the light emitting element 48 and the light receiving element 49 are input to the microcomputer 95*b* via the sensor control section 95C (when the trailing end of the card C shown in FIG. 9 is detected). To avoid a possible error between the above-described design values and actual values, the microcomputer 95*b*, serving as a determination section, calculates a correction value for adjustably increasing or reducing the number of print lines on the card C in the sub-scanning direction. In the present embodiment, the microcomputer 95*b* also functions as correction value calculating means for calculating the correction value.

The calculation of the correction value requires detection of the change in the tension of the ink ribbon R or the environmental temperature, which is a factor (cause) increasing or reducing the number of print lines. The change in the tension of the ink ribbon R is indirectly detected and determined by utilizing, in the present embodiment, the encoder 121 (see FIG. 8. The encoder 121 is denoted by reference numeral 97 in FIG. 7) as a ribbon tension change detecting means for detecting the change in the tension of the ink ribbon R; the encoder 121 also serves as spool rotation amount detecting means to detect the rotation amount of the ribbon supply reel (ribbon supply spool).

Figure 10A:
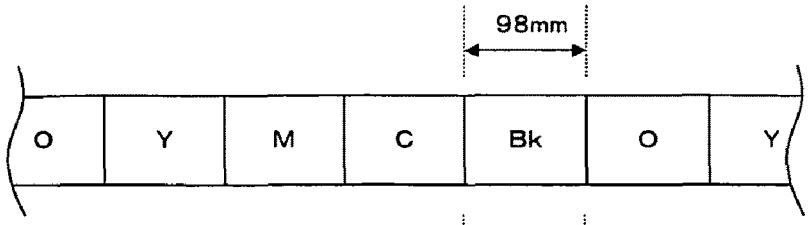
Figure 10B:
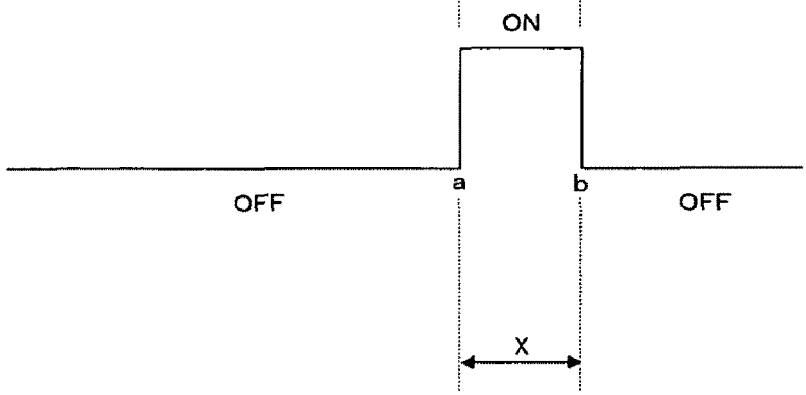
Figure 10C:
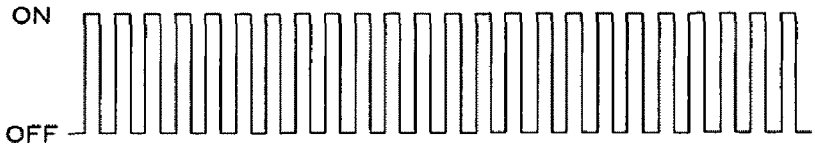

As shown in FIG. 10(A), the length of the black (Bk) panel of the ink ribbon R is constant at 98 mm. The black panel is detected as a light blocking condition by the transmission sensor made up of the light emitting element 58 and the light receiving element 59. The detection of the light blocking condition starts at a point (pulse rise point) denoted by reference numeral (a) in FIG. 10(B). Similarly, the detection of the light blocking condition ends at a point (pulse fall point) denoted by reference numeral (b). As shown in FIG. 10(C), while the encoder 121 (see FIG. 8. The encoder 121 is denoted by reference numeral 97 in FIG. 7) is detecting the light blocking condition by means of the above-described transmission sensor (the detection is on), a clock count (see X in the figure) relating to the rotation amount of the ribbon supply reel (ribbon supply spool) is detected. The clock count, shown by X in the figure, increases with decreasing ribbon diameter of the ribbon supply reel (ribbon supply spool) 54.

The clock count is detected for each of the black (Bk) panels sequentially arranged in the ink ribbon R as shown in FIG. 10(A); the detection of the clock count is based on the length of the black (Bk) panel of the ink ribbon R, 98 mm (constant value), and relates to the rotation amount of the ribbon supply reel (ribbon supply spool). For each black (Bk) panel, the latest detection data is written to the RAM in the microcomputer 95*b* via the sensor control section 95*c*. Then, as shown in FIG. 10(C), using, as a trigger, the timing when the trailing end of the card C in the conveying direction is detected by the transmission sensor made up of the light emitting element 48 and the light receiving element 49 and serving as the card end detecting means, the microcomputer 95*b* as the determination section instructs the thermal head control section 95*e* to adjustably increase or reduce the number of print lines on the card C in the sub-scanning direction based on the correction value described below. Electric conduction through the thermal head 51 (heating elements 51*a*) is thus controlled.

During the printing of the card C, when the trailing end of the card C is detected by the transmission sensor made up of the light emitting element 48 and the light receiving element 49, the microcomputer 95*b* (CPU) as the determination section functions as the correction value calculating means to calculate the correction value from the environmental temperature data stored in the ROM and the clock count relating to the rotation amount of the ribbon supply reel (ribbon supply spool) 54. More specifically, the microcomputer 95*b* (CPU) calculates the correction value assigned based on the dependency of the environmental temperature data (see an "Adj" section in Table 1 shown adjacent to temperature data on the axis of ordinate and in an axis of ordinate direction. The data is expressed in terms of the number of print lines) and the dependency of the clock count (see an "Adj" section in Table 1 shown under clock count data on the axis of abscissa and in an axis of abscissa direction) relating to the rotation amount of the ribbon supply reel (ribbon supply spool) 54 (the correction value is shown at the intersecting point between the dependency values).

Table 1 is a matrix-like correction table showing correction values. However, in the present embodiment, independent arrangements hold both the environmental temperature data and the related dependency data and both the clock count relating to the rotation amount of the ribbon supply reel (ribbon supply spool) 54 and the related dependency data, respectively. The microcomputer 95*b* (CPU) calculates these data. Of course, a configuration may be adopted such that such a correction table as shown in Table 1 may be prepared so as to allow a desired correction value to be read from the table.

Description will be given below using actual numerical values. Reference conditions for the numerical values in Table 1 are set such that the apparatus is in the environment in which the print size is most likely to increase, the temperature is high (that is, the outer diameter dimension of the platen roller 44 is large), and the tension of the ink ribbon R, which affects the card C being conveyed, is highest (the winding diameter on the ribbon supply spool side is large and the clock count, associated with the rotation amount, is small). That is, the reference conditions in the table are a temperature of 45° C. and a supplied clock count of at most 430.

In the present embodiment, under the above-described reference conditions, when the trailing end of the card C shown in FIG. 9 is detected, the number of print lines that can be printed in the unprinted area shown by reference character L in FIG. 9 is set to 292. Here, the set number of print lines, 292, is different from the number of print lines corresponding to the unprocessed distance L (25 mm), 295, by 3. This indicates that the size resulting from printing under the above-described reference conditions is larger than the design value by an amount corresponding to 3 lines.

For example, if the thermistor 96 detects an environmental temperature of 21° C. and the encoder 97 (shown by reference numeral 121 in FIG. 8) detects a supplied clock count of 600, the dependency corresponding to the environmental temperature of 21° C. is 1.4, and the dependency corresponding to the supplied clock count of 600 is 0.8. Thus, the microcomputer 95*b* (CPU) adds the dependency data together to obtain a correction amount of 2.2. In this case, the print size is determined to decrease from the one obtained under the above-described reference conditions, by an amount corresponding to 2.2 lines. Thus, a correction value of 2.2 lines is added to the number of print lines that can be printed in the unprinted area under the reference conditions, 292, to determine the number of print lines printed in the unprinted area to be 294.2 lines.

In the present embodiment, numerical values of less than 1 are rounded down. However, a process such as carry or round-off may be used. Moreover, in the present embodiment, the reference conditions are strictly set. However, if such different conditions as provide opposite results are set, a subtraction process may be executed using the correction value. Moreover, in the present embodiment, the correction value is calculated according to the detection data on the environmental temperature and the clock count relating to the rotation amount of the ribbon supply reel (ribbon supply spool) 54 and used as an example of detection of the change in the tension of the ink ribbon R. However, an arrangement may be used in which the correction amount is calculated according to one of the detection data on the environmental temperature and the clock count.

The above-described correction process allows possible problems such as breakage of the ink ribbon R to be prevented to enable overall printing of the card C. In the description of the present embodiment, the clock count relating to the rotation amount of the ribbon supply reel (ribbon supply spool) 54 is illustrated for the technique of detecting the change in the tension of the ink ribbon R. However, the present invention is not limited to this aspect. A clock count relating to the ribbon takeup reel (ribbon takeup spool) 55 may be detected or the outer diameter dimension of the ink ribbon R may be directly detected. Furthermore, a technique may be adopted which counts the consumption of the ribbon fed out from the ribbon supply reel (ribbon supply spool) 54 to detect the change in the tension of the ink ribbon R based on an integrated value for the consumption. Alternatively, a technique may be adopted which allows a rollable roller-like member to abut against the ink ribbon R so that a rolling position of the member can be detected by a plurality of sensors to directly detect the tension of the ink ribbon.

TABLE 1

| | | Supplied clock | | | | | |
|---|---|---|---|---|---|---|---|
| Temperature (° C.) | Adj | -430 0.0 | -460 0.2 | -500 0.4 | -560 0.6 | -650 0.8 | 651-1.0 |
| 10 | 2.0 | 2.00 | 2.20 | 2.40 | 2.60 | 2.80 | 3.00 |
| 11 | 2.0 | 2.00 | 2.20 | 2.40 | 2.60 | 2.80 | 3.00 |
| 12 | 2.0 | 2.00 | 2.20 | 2.40 | 2.60 | 2.80 | 3.00 |
| 13 | 1.8 | 1.80 | 2.00 | 2.20 | 2.40 | 2.60 | 2.80 |
| 14 | 1.8 | 1.80 | 2.00 | 2.20 | 2.40 | 2.60 | 2.80 |
| 15 | 1.8 | 1.80 | 2.00 | 2.20 | 2.40 | 2.60 | 2.80 |
| 16 | 1.6 | 1.60 | 1.80 | 2.00 | 2.20 | 2.40 | 2.60 |
| 17 | 1.6 | 1.60 | 1.80 | 2.00 | 2.20 | 2.40 | 2.60 |
| 18 | 1.6 | 1.60 | 1.80 | 2.00 | 2.20 | 2.40 | 2.60 |
| 19 | 1.4 | 1.40 | 1.60 | 1.80 | 2.00 | 2.20 | 2.40 |
| 20 | 1.4 | 1.40 | 1.60 | 1.80 | 2.00 | 2.20 | 2.40 |
| 21 | 1.4 | 1.40 | 1.60 | 1.80 | 2.00 | 2.20 | 2.40 |
| 22 | 1.2 | 1.20 | 1.40 | 1.60 | 1.80 | 2.00 | 2.20 |
| 23 | 1.2 | 1.20 | 1.40 | 1.60 | 1.80 | 2.00 | 2.20 |
| 24 | 1.2 | 1.20 | 1.40 | 1.60 | 1.80 | 2.00 | 2.20 |
| 25 | 1.0 | 1.00 | 1.20 | 1.40 | 1.60 | 1.80 | 2.00 |
| 26 | 1.0 | 1.00 | 1.20 | 1.40 | 1.60 | 1.80 | 2.00 |
| 27 | 1.0 | 1.00 | 1.20 | 1.40 | 1.60 | 1.80 | 2.00 |
| 28 | 0.8 | 0.80 | 1.00 | 1.20 | 1.40 | 1.60 | 1.80 |
| 29 | 0.8 | 0.80 | 1.00 | 1.20 | 1.40 | 1.60 | 1.80 |

TABLE 1-continued

| | | Supplied clock | | | | | |
|---|---|---|---|---|---|---|---|
| Temperature (° C.) | Adj | -430 0.0 | -460 0.2 | -500 0.4 | -560 0.6 | -650 0.8 | 651-1.0 |
| 30 | 0.8 | 0.80 | 1.00 | 1.20 | 1.40 | 1.60 | 1.80 |
| 31 | 0.6 | 0.60 | 0.80 | 1.00 | 1.20 | 1.40 | 1.60 |
| 32 | 0.6 | 0.60 | 0.80 | 1.00 | 1.20 | 1.40 | 1.60 |
| 33 | 0.6 | 0.60 | 0.80 | 1.00 | 1.20 | 1.40 | 1.60 |
| 34 | 0.4 | 0.40 | 0.60 | 0.80 | 1.00 | 1.20 | 1.40 |
| 35 | 0.4 | 0.40 | 0.60 | 0.80 | 1.00 | 1.20 | 1.40 |
| 36 | 0.4 | 0.40 | 0.60 | 0.80 | 1.00 | 1.20 | 1.40 |
| 37 | 0.2 | 0.20 | 0.40 | 0.60 | 0.80 | 1.00 | 1.20 |
| 38 | 0.2 | 0.20 | 0.40 | 0.60 | 0.80 | 1.00 | 1.20 |
| 39 | 0.2 | 0.20 | 0.40 | 0.60 | 0.80 | 1.00 | 1.20 |
| 40 | 0.0 | 0.00 | 0.20 | 0.40 | 0.60 | 0.80 | 1.00 |
| 41 | 0.0 | 0.00 | 0.20 | 0.40 | 0.60 | 0.80 | 1.00 |
| 42 | 0.0 | 0.00 | 0.20 | 0.40 | 0.60 | 0.80 | 1.00 |
| 43 | 0.0 | 0.00 | 0.20 | 0.40 | 0.60 | 0.80 | 1.00 |
| 44 | 0.0 | 0.00 | 0.20 | 0.40 | 0.60 | 0.80 | 1.00 |
| 45 | 0.0 | 0.00 | 0.20 | 0.40 | 0.60 | 0.80 | 1.00 |

(Operation)

Now, the printing process operation of the printer apparatus 1 according to the present embodiment will be described mainly in conjunction with the CPU of the microcomputer 95*b* (hereinafter simply referred to as the CPU).

For operations of the printer apparatus 1 other than the printing process, see U.S. patent application Ser. No. 12/003,260.

A printer driver installed in the higher-order apparatus 100 determines various parameters required to control the recording operation of the printer apparatus 1 based on a recording instruction specified by an operator (user). Based on the recording instruction, the printer driver generates and transmits print recording data and magnetic recording data to be recorded on the card, to the printer apparatus 1. The buffer memory 95*a* of the control section 95 stores various parameter values serving as recording control instructions, image data or text data obtained by decomposing print recording data into color components Y, M, C, and Bk, and magnetic recording data. In the present embodiment, the higher-order apparatus 100 decomposes the original data (R, G, and B) into the color components, and the printer apparatus 1 converts the color components R, G, and B into Y, M, and C and uses the resulting color components as image data. Bk data extracted by the higher-order apparatus is used in the printer apparatus 1 as Bk data for text data.

In the meantime, the CPU drives a motor (not shown in the drawings) to wind the ink ribbon R from the cartridge 52 around the ribbon takeup reel 55. Then, using, as a trigger, a point when the transmission sensor made up of the light emitting element 58 and the light receiving element 59 detects an end of the ink layer BK (black) (when the light receiving element 59 detects that light emission from the light emitting element changes from a non-transmission condition to a transmission condition owing to the ink layer Br), the CPU further drives the motor (not shown in the drawings) by a predetermined number of steps to set the ink ribbon R in position so as to place a leading end of the ink layer Y (yellow) at the position of the thermal head 51 and the platen roller 44.

Then, the CPU drives the conveyance driving motor 70 to convey the card C on the card conveying path P1 toward a card carry-out port 82 side. The CPU further allows the first card detecting sensor made up of the light emitting element 48 and the light receiving element 49 to detect the position of the leading end of the card C. The CPU then allows the printing section 50 to print a desired text or image on the surface of the card C based on the print recording data. That is, the thermal head 51 is pressed against the surface of the card C via the ink ribbon R (the portion of the ink layer Y), while the heating elements of the thermal head 51 are selectively operated according to Y color image data (image data on the Y component obtained by subjecting RGB data to color conversion). Thus, Y (yellow) thermal-transfer ink component coated on the ink ribbon R is transferred directly to the surface of the card C.

At this time, a back surface side of the card C is supported by the platen roller 44. First, the card C is sandwiched and conveyed by the conveying rollers 42 and 43 and then conveyed on the card conveying path P1 toward the card carry-out port 82. During the conveyance, the leading end side of the card C is sandwiched and held by the nip roller 45, whereas the trailing end side of the card C is sandwiched and held by the conveying roller 43. Finally, (with the back surface side of the trailing end side of the card C supported by the platen roller 44) the card C is sandwiched and held by the nip roller 45. Thus, during the print recording by the printing section 50, the conveying rollers 42 and 43 and the nip roller 45 function as a capstan roller that sandwiches, holds and conveys the card C at a constant speed. The CPU allows the card detecting sensor made up of the light emitting element 49 and the light receiving element 49 to detect the position of the trailing end of the card C. The CPU continues to drive the conveyance driving motor 70 forward by an amount corresponding to a predetermined number of pulses and then stops driving the conveyance driving motor 70.

Then, the CPU reversely drives the conveyance driving motor 70 to reversely convey the card C along the card conveying path P1 toward the card supply port 14. When the latter half of the card C in the conveying direction is stopped and held by the conveying rollers 42 and 43, and the former half of the card C in the conveying direction is supported by the conveying roller 41, the driving of the conveyance driving motor 70 is stopped (see FIG. 5). In the meantime, the CPU drives the motor (not shown in the drawings) to slightly wind the ink ribbon R from the cartridge 52 around the ribbon takeup reel 55. Thus, a leading end of the ink layer M (magenta) is placed at the position of the thermal head 51 and the platen roller 44. The CPU further allows the printing section 50 to transfer an M (magenta) thermal-transfer ink component coated on the ink ribbon R directly to the surface of the card C. Similarly, the CPU allows the printing section 50 to transfer a C (cyan) thermal-transfer ink component and a Bk (black) thermal-transfer ink component coated on the ink ribbon R directly to the surface of the card C. Thus, a color image of Y, M, C, and Bk is formed on the surface of the card C.

Figure 4:
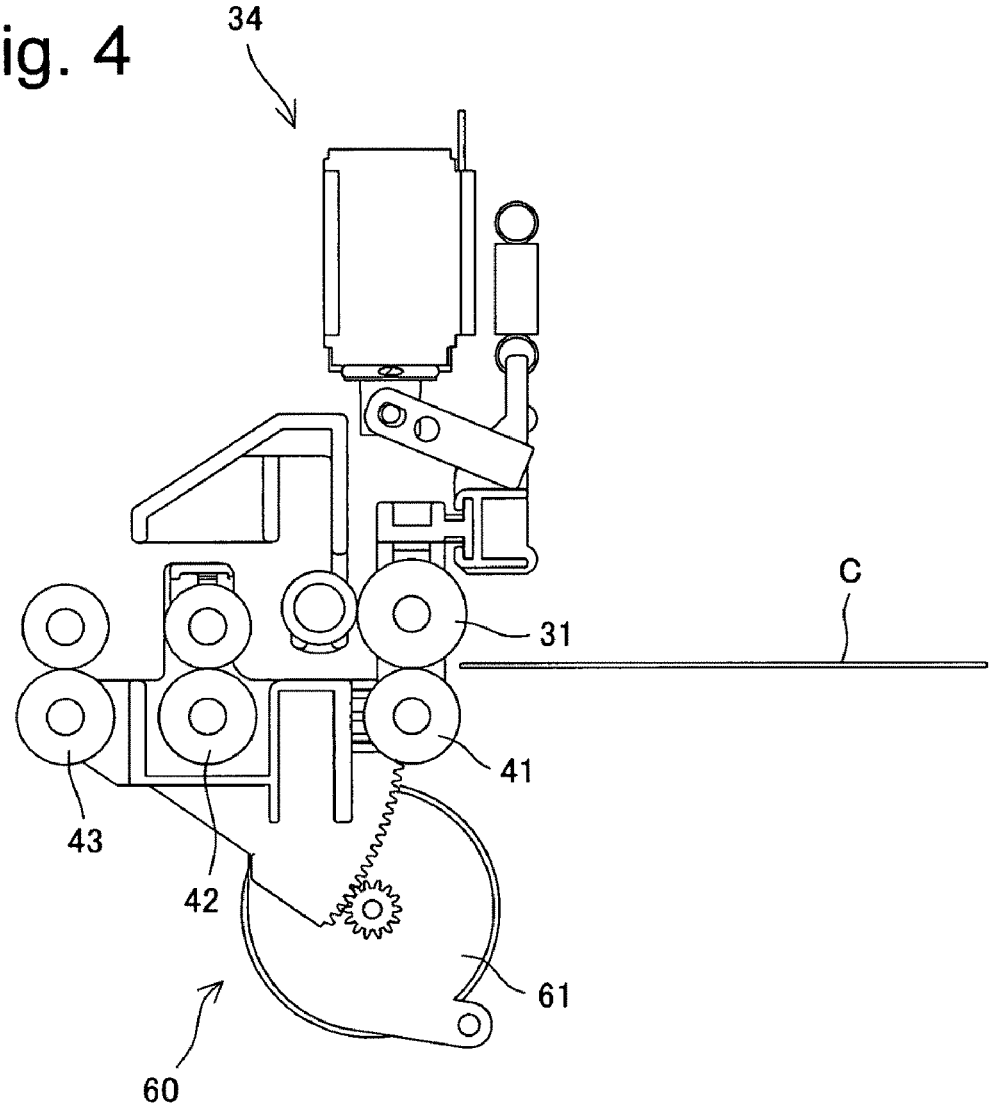
FIG. 4 is a partly enlarged view illustrating operations of a conveying roller moving mechanism and a card cleaning mechanism, wherein a card is received.
Figure 5:
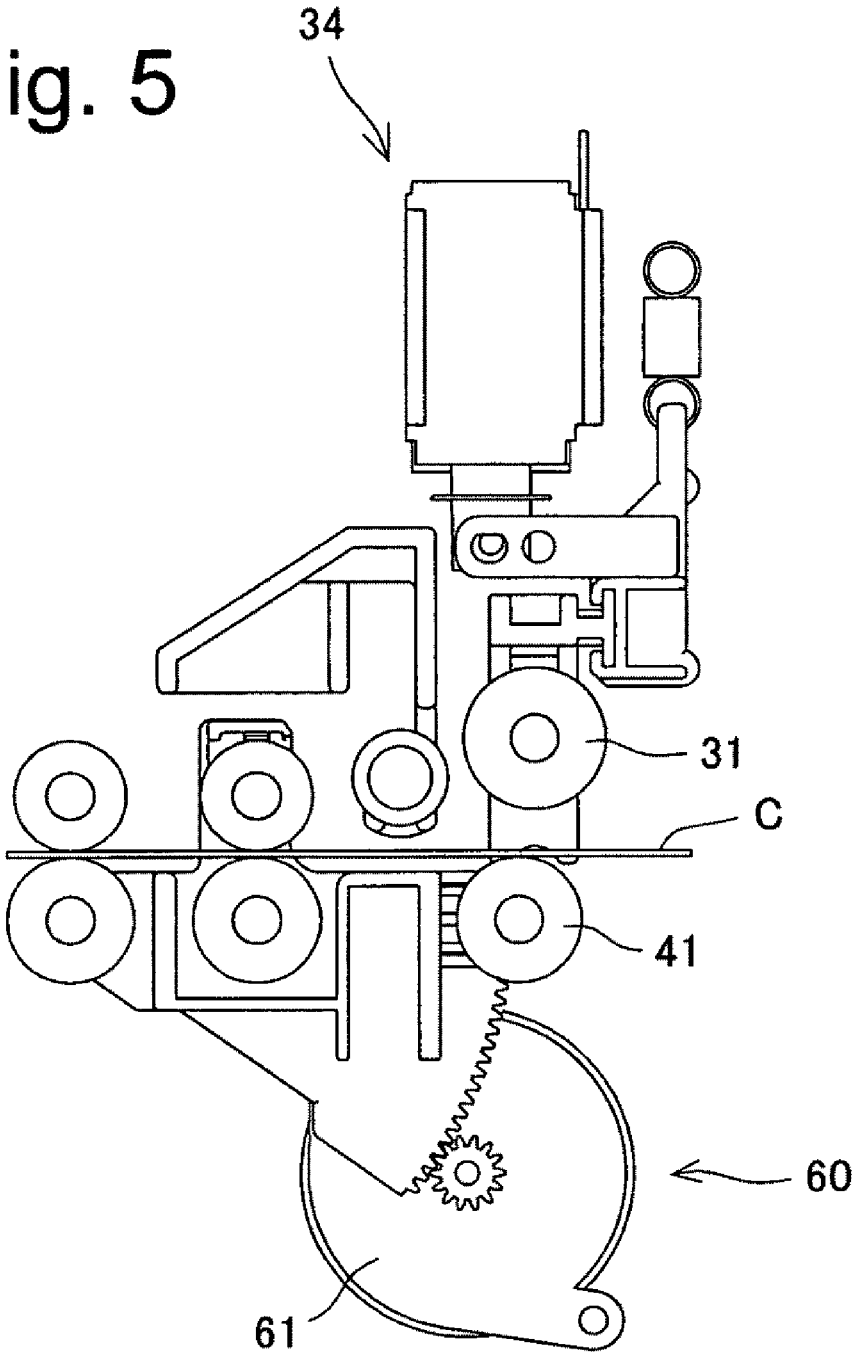
FIG. 5 is a partly enlarged view illustrating the operation of the conveying roller moving mechanism and the card cleaning mechanism, wherein the card is inversely conveyed for multicolor field-sequential printing.

Then, the CPU conveys the card C toward the card discharge port 23. That is, the CPU reversely drives the conveyance driving motor 70 to reversely convey the card C along the card conveying path P1 toward the card supply port 14. As shown in FIGS. 4 and 5, when the printing section 50 performs multicolor sequential print recording on the print surface of the card C and when the card C is reversely conveyed toward the card supply port 14 side (the condition shown in FIG. 5), the conveying rollers 41 and 42 are held at a first position where the conveying rollers 41 and 42 are located so as to form a substantially horizontal card conveying path. However, to discharge the card C already subjected to the predetermined recording process, toward the card discharge port 23, the CPU uses, as a trigger, a point when the card detecting sensor made up of the light emitting element 48 and the light receiving element 49 detects the trailing end of the card C being reversely conveyed on the card conveying path P1 or a point in time corresponding to a number of pulses after the detection of the trailing end of the card C, to drivingly control the stepping motor 61 to allow a moving mechanism 60 (driving of a stepping motor 61) to move the conveying rollers 41 and 42 to a second position where the conveying rollers 41 and 42 are positioned so as to form an inclined card conveying path. The CPU further reversely drives the motor (not shown in the drawings) that rotationally drives the above-described supply roller 11, to rotationally drive the discharge roller 15.

Figure 6:
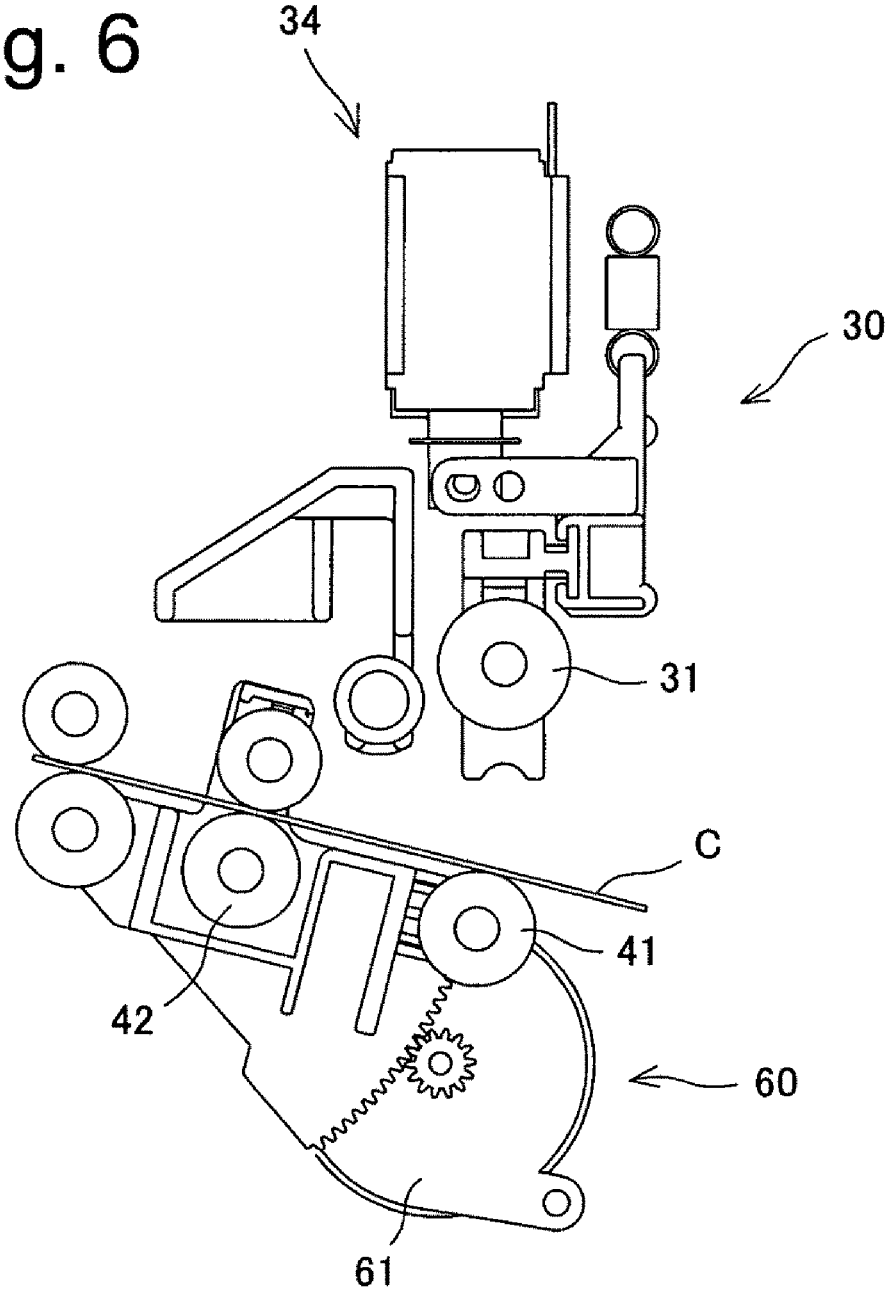
FIG. 6 is a partly enlarged view illustrating the operations of the conveying roller moving mechanism and the card cleaning mechanism, wherein the card already subjected to the recording process is discharged.

Thus, the card C is placed in the card accommodating section 20 via the card discharge port 23 or (if the card accommodating section 20 is full of cards) discharged to the exterior through the card discharge port 21. During discharging of the card shown in FIG. 6, a cleaning roller 31 is placed at a retract position that is a home position located away from the card conveying path P1.

When the card C is placed in the card accommodating section 20 or discharged through the card discharge port 21, the CPU stops the reverse driving of the conveyance driving motor 70 and the motor (not shown in the drawings). At a predetermined timing when the operation of discharging the card C to the card accommodating section 20 is completed, the CPU drives the stepping motor 61 again (rotational driving in the reverse direction) to return the conveying rollers 41 and 42 from the second position where the conveying rollers 41 and 42 are positioned so as to form the inclined card conveying path to the first position where the conveying rollers 41 and 42 are positioned so as to form the substantially horizontal card conveying path. Thus, the process of printing the card C is completed. If another job needs to be carried out, the above-described operation is repeated.

Now, the effects of the method of controlling the electric conduction through the thermal head 51 and the printer apparatus (thermal printer) 1 will be described.

The method of controlling the electric conduction through the thermal head 51 detects the environmental temperature, directly or indirectly detects the change in the tension of the ink ribbon R, reads or calculates the correction value according to at least one of the detected environmental temperature and the detected change in the tension of the ink ribbon R, and controls the thermal energy of each heating element 51*a* in the thermal head 51 based on the correction value so as to adjustably increase or reduce the number of print lines on the card C in the sub-scanning direction. Thus, the method prevents possible problems such as breakage of the ink ribbon R to enable overall printing of the print target medium. To adjustably increase or reduce the number of print lines on the card C, the method, upon detecting the trailing end of the card C being conveyed, determines the number of print lines corresponding to the unprinted area (reference character L shown in FIG. 9) of the card C and adjustably increase the correction value to the number of print lines. Consequently, the end of the card C can be accurately printed, thus preventing such possible problems as described above.

The printer apparatus (thermal printer) 1 according to the present embodiment includes the thermal head 51 with the plurality of heating elements 51*a*, the platen roller 44 provided at the print position for the card C on the conveying path, the ink ribbon R in which the predetermined ink is stacked and from which the ink is transferred to the card-like print medium by the heat from the thermal head 51, the thermistor 96 detecting the environmental temperature, the microcomputer 95*b* including the function of the ribbon tension detecting means for directly or indirectly detecting the change in the tension of the ink ribbon R and the function of the correction value calculating means for calculating the correction value based on at least one of the temperature data and the ribbon tension change data, and the thermal head control section 95*e* controlling thermal energy provided to the thermal head 51 based on the correction value calculated by the correction value calculating means so as to adjustably increase or reduce the number of print lines on the card C in the sub-scanning direction. Thus, the overall printing is esthetically achieved on the print target medium, while preventing a possible disadvantageous situation in which the print size varies to displace the thermal head from an end of the print target medium while the printing output is continued in this condition, causing the ink ribbon to be broken by heating.

Moreover, the apparatus further includes the transmission sensor made up of the light emitting element 48 and the light receiving element 49 to detect the trailing end, in the conveying direction, of the card C being conveyed, and the microcomputer 95*b* (CPU) performing the predetermined determination based on the detection signal from the transmission sensor. The microcomputer 95*b* (CPU) is configured to, when the detection signal from the transmission sensor is input to the microcomputer 95*b* (CPU), determine the number of print lines corresponding to the unprinted area (reference character L shown in FIG. 9) on the card C and instruct the thermal head control section 95*e* to add the correction value to the number of print lines to apply the corresponding thermal energy to the thermal head 51. Thus, the end of the card C can be accurately printed to further properly prevent the above-described possible problem.

Furthermore, in the present embodiment, the system configuration with the higher-order apparatus 100 is illustrated. However, the printer apparatus 1 may include a medium reading section reading data recorded in, for example, an MO, a CD, or a DVD so that the printer apparatus 1 can be operated according to recording operation instructions from the operation panel section 5.

The disclosure of Japanese Patent Application No. 2007-286786 filed on Nov. 2, 2007 is incorporated herein as a reference.

While the invention has been explained with reference to the specific embodiment of the invention, the explanation is illustrative, and the invention is limited only by the appended claims.

What is claimed is:

1. A method of controlling electric conduction through a thermal head, comprising the steps of:

detecting an environmental temperature, detecting a change in tension of an ink ribbon directly or indirectly, obtaining a correction value according to at least one of the detected environmental temperature and the detected change in the tension of the ink ribbon, the correction value increasing or decreasing print lines in a sub-scanning direction of a print medium, and controlling thermal energy of each heating element in the thermal head based on the correction value so that the thermal head increases or decrease a number of the print lines on the print medium in the sub-scanning direction to correct a printing area on the print medium.

2. The method of controlling electric conduction according to claim 1, wherein the step of controlling the thermal energy for adjustably increasing or reducing the number of print lines on the print medium includes a step of conveying the print medium; a step of determining a number of print lines corresponding to an unprinted area on the print medium when a trailing end of the print medium being conveyed is detected; and a step of adding a correction value to the number of print lines.

3. The method of controlling electric conduction according to claim 1, wherein the detected environmental temperature is a temperature of an external environment in which a printer body is installed, and is detected by a thermistor provided inside the printer body.

4. The method of controlling electric conduction according to claim 1, wherein the detected environmental temperature is a temperature inside a printer body detected by a thermistor provided near a print position for the print medium.

5. The method of controlling electric conduction according to claim 1, wherein the step of detection of the change in the tension of the ink ribbon includes a step of detecting an amount of rotation of a spool around which the ink ribbon is wound.

6. The method of controlling electric conduction according to claim 5, wherein the detection of the amount of rotation of the spool is based on an amount of rotation of the spool corresponding to a conveying distance of a predetermined one of a plurality of ink panels sequentially arranged in the ink ribbon, light ray from a transmission sensor blocking said predetermined one ink panel.

7. The method of controlling electric conduction according to claim 1, wherein the step of detection of the change in the tension of the ink ribbon includes a step of detecting an outer diameter of the ink ribbon wound around the spool.

8. The method of controlling electric conduction according to claim 1, wherein the step of detection of the change in the tension of the ink ribbon includes a step of detecting a consumption of the ink ribbon fed from a supply spool.

9. The method of controlling electric conduction according to claim 1, wherein the change in the tension of the ink ribbon is detected by directly detecting the tension of the ink ribbon before or after a conveying and printing process.

10. The method of controlling electric conduction according to claim 1, wherein the correction value is calculated from the detected environmental temperature and a value corresponding to the change in the tension of the ink ribbon, and the correction value as an integer value is adjusted so as to increase or reduce a number of print lines on the print medium in the sub-scanning direction.

11. The method of controlling electric conduction according to claim 1, wherein the correction value is read from a correction table made of the detected environment temperature and the value corresponding to the change in the tension of the ink ribbon, and the correction value as an integer value is adjusted so as to increase or reduce the number of the print line on the print medium in the sub-scanning direction.

* * * * *